United States Patent [19]

Kirschner

[11] Patent Number: 4,997,113

[45] Date of Patent: Mar. 5, 1991

[54] ORIFICE INSERTION AND REMOVAL DEVICE FOR A POST-MIX BEVERAGE VALVE

[75] Inventor: Jonathan Kirschner, Marietta, Ga.

[73] Assignee: The Coca-Cola Company, Atlanta, Ga.

[21] Appl. No.: 22,508

[22] Filed: Mar. 9, 1987

Related U.S. Application Data

[63] Continuation of Ser. No. 735,199, May 17, 1985, abandoned.

[51] Int. Cl.[5] ..... B65D 47/00

[52] U.S. Cl. ..... 222/547; 222/564; 239/596

[58] Field of Search ..... 222/129.1–129.4, 222/145, 481, 545, 547, 563, 564; 239/596; 138/40, 44–46; 215/296, 298

[56] References Cited

U.S. PATENT DOCUMENTS

| | | | |
|---|---|---|---|
| 2,770,383 | 11/1956 | Livas | 215/296 |
| 3,084,718 | 4/1963 | Ash | 239/596 X |
| 3,357,047 | 12/1967 | Keil et al. | 239/596 X |
| 3,584,762 | 6/1971 | Vantroba | 222/129.1 X |
| 4,270,673 | 6/1981 | Rodth | 222/129.3 |
| 4,306,667 | 12/1981 | Sedam et al. | 222/91 X |

FOREIGN PATENT DOCUMENTS

| | | |
|---|---|---|
| 1774408 | 9/1958 | Fed. Rep. of Germany . |
| 1815006 | 7/1970 | Fed. Rep. of Germany . |

*Primary Examiner*—David H. Bollinger

*Attorney, Agent, or Firm*—Birch, Stewart, Kolasch & Birch

[57] ABSTRACT

An orifice disc insertion and removal device for the syrup tube of the mixing valve of a post-mix beverage dispenser, comprising a cylindrical plastic adaptor having an inside shoulder on which interchangeable orifice plates are disposed, a flange on the opposite end thereof which seats on the end of the syrup tube to accurately position the orifice device and a pull-tab connected to the flange for removing the cylindrical adaptor from within the syrup tube.

14 Claims, 1 Drawing Sheet

ORIFICE INSERTION AND REMOVAL DEVICE FOR A POST-MIX BEVERAGE VALVE

This application is a continuation of application Ser. No. 735,199 filed on May 17, 1985, now abandoned.

BACKGROUND OF THE INVENTION

The present invention relates to a device for manually inserting and removing interchangeable flow-rate control orifice discs into or from a syrup supply tube of a post-mix beverage dispenser.

As disclosed in U.S. Pat. No. 4,306,667 to Sedam, et al., issued Dec. 22, 1981, it is desirable to utilize interchangeable flow-rate control orifice discs of selected orifice sizes in the syrup supply tubes of post-mix beverage dispensers. The orifice sizes are selected in relation to the brix of the syrup or flavor concentrate and the relative flow rate of the water (still or carbonated) with which the syrup is to be mixed to form the post-mix beverage.

The use of interchangeable orifice discs in syrup supply tubes is also disclosed in U.S. Pat. No. 4,270,673 to Rodth.

Heretofore, when the orifice discs were to be located within the syrup tubes near the output end of the tube in the mixing chamber region of the dispensing valve assembly, it was common practice to use stainless steel discs with slightly beveled edges to preclude damage to the syrup tubes at least during the insertion process. These discs were then press fit into the syrup tubes by a special tool and then removed from the tubes by a hook-shaped portion of that tool. Because the discs are very thin and the syrup tube walls are plastic, damage to the tube walls could result during removal thereof, and in most instances the disc would be destroyed, precluding reuse thereof.

This problem is avoided to a certain extent by the invention described in the aforementioned U.S. Pat. No. 4,270,673 to Rodth which discloses a cylindrical plastic adaptor 98 with interchangeable orifice discs 100 seated on an inside shoulder thereof. This adaptor fits onto the outside end of syrup tube 82, the orifice discs 100 seating against the tube end. Therefore, with the adaptor of Rodth it is not necessary to insert the orifice discs into the tube or to remove them therefrom. However, the adaptor of Rodth, mounted on the outside of the syrup tube, takes up space in the valve assembly and may interfere with surrounding parts, making it difficult to retrofit the adaptor to valve assemblies of various manufacturers.

SUMMARY OF THE INVENTION

Accordingly, it is a primary object of the present invention to provide a device for inserting and removing orifice discs into or from syrup tubes without damaging the tube or disc.

It is a further object of the present invention to provide an adaptor for accurately seating an orifice disc at a predetermined position in a syrup tube and for supporting the disc at that position during operation of the dispenser.

It is another object of the present invention to provide an adaptor for holding an orifice disc in a syrup tube which may be manually grasped by an operator's fingers and readily removed from the syrup tube.

The objects of the present invention are fulfilled by providing an orifice disc insertion and removal device for inserting and removing the disc from the interior of a syrup tube associated with the mixing chamber of a post-mix beverage dispenser, the orifice disc including a thin disc with an orifice therein having a diameter selected to provide a predetermined rate of syrup flow into the mixing chamber for a given brix value, comprising:

(a) a cylindrical body with an outside diameter slightly greater than the inside diameter of a syrup tube into which the cylindrical body and orifice disc are to be inserted;

(b) an inside, recessed, annular shoulder on one end of said cylindrical body forming a socket for supporting interchangeable orifice discs;

(c) a flange on the opposite end of said cylindrical body which is adapted to seat on the end of a syrup tube into which the body is inserted to accurately position an orifice disc disposed in said socket at a fixed position inside of the syrup tube; and (d) a pull tab extending from said flange to permit the manual removal of said cylindrical body and orifice disc from said syrup tube when pulled by an operator's fingers.

DETAILED DESCRIPTION OF PREFERRED EMBODIMENTS

The present invention will become more fully understood from the detailed description given hereinbelow and the accompanying drawings which are given by way of illustration only, and thus are not limitative of the present invention, and wherein.

Figure 1:
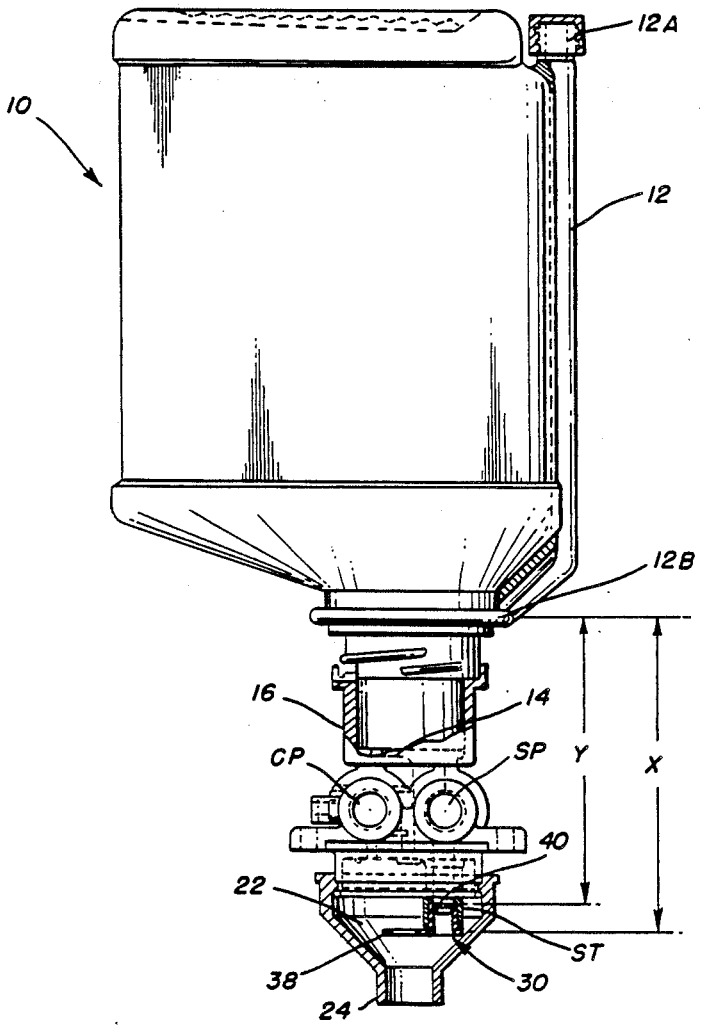
FIG. 1 is a diagrammatic illustration of how the orifice disc insertion and removal device of the present invention is utilized in combination with a gravity flow syrup container and valve assembly of a post-mix beverage dispenser.

Referring in detail to FIG. 1, there is illustrated in diagrammatic form the combination of a gravity flow syrup container 10; a valving assembly including a socket 16 for receiving the discharge end 14 of the container 10, a mixing chamber 22, and a dispensing nozzle 24; and an orifice disc adaptor 30 of the present invention inserted within a syrup supply tube ST which extends into the interior of the mixing chambers 22. The generic combination of FIG. 1, with the exception of the adaptor 30, is illustrated in the aforementioned U.S. Pat. No. 4,306,667 to Sedam, et al. The valve assembly, including the socket, mixing chamber, nozzle and syrup tube, is best illustrated in the cross-sectional view of FIG. 13B thereof and the gravity flow syrup container is illustrated in FIG. 1 thereof.

In the illustration of FIG. 1 of the present invention, the gravity-flow syrup container 10 is of the type illustrated in copending U.S. Pat. Application Ser. No. 623,192, filed Jun. 21, 1984, now abandoned, and assigned to the same assignee as the present invention. Container 10 is provided with a flow rate control tube 12 integrally molded with the sidewalls of the container, having an openable end 12A with a removable cap thereon. When the cap is removed, atmospheric pressure is communicated through open end 12A, and tube 12 to a point 12B inside of the container 10 just above the neck portion thereof. That is, tube 12 opens into container 10 at point 12B to provide atmospheric pressure to the liquid in the container at that point. Point 12B is positioned at a predetermined distance X above the bottom of syrup tube ST, and a distance Y above any orifice disc 40 which is inserted into the syrup tube ST. It is important that the orifice disc 40 always be positioned at a distance Y from point 12B so that the liquid pressure head is a constant for determining the proper orifice sizes for the brix of syrup being dispensed. Accurate positioning of the orifice disc 40 is provided by the bottom flange 36 of the cylindrical adaptor 30, to be described in more detail hereinafter with reference to FIGS. 2 and 3.

As further illustrated in FIG. 1, and as further described in the Sedam Patent 4,306,667, the valve assembly further includes appropriate syrup valves SP and carbonated water valve CP. These valves are simultaneously actuated to provide syrup and carbonated water to the mixing chamber 22, the syrup flowing from the discharge opening 14 of container 10 through syrup valve SP, syrup tube ST, and any orifice disc 40 disposed therein. To the extent necessary to facilitate an understanding of the present invention, the prior U.S. Pat. No. No. 4,306,667 to Sedam et al. is incorporated herein by reference.

Figure 2:
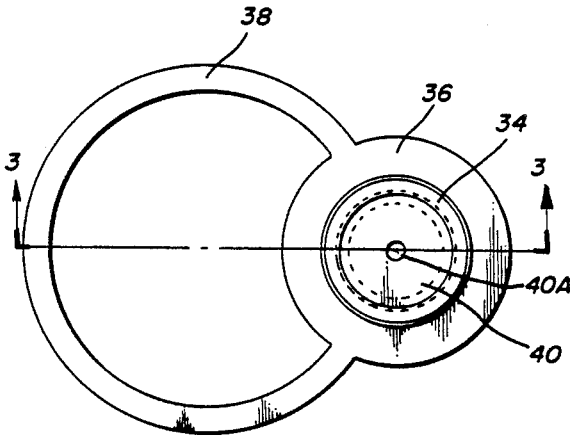
FIG. 2 is a top plan view of the orifice disc insertion and removal device of the present invention.
Figure 3:
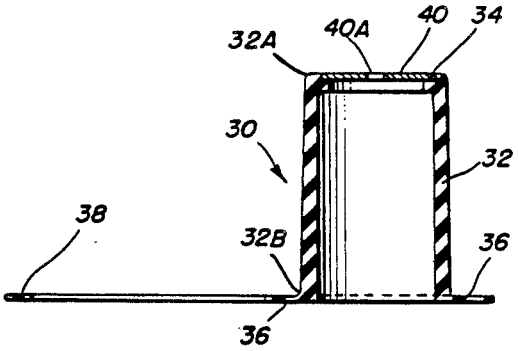
FIG. 3 is a cross-sectional view taken along line 3—3 of FIG. 2 showing the orifice insertion and removal device in elevation.

Referring to FIGS. 2 and 3, which illustrate the adaptor 30 per se, it can be seen that the adaptor 30 has a main cylindrical body portion 32 with distal ends 32A and 32B. The diameter of body portion 32 is slightly greater than the inside diameter of syrup tube ST, providing a force fit therein. End 32A is counterbored in the provision of an annular shoulder 34 for supporting an orifice disc 40 of stainless steel or the like with a central aperture 40A of a selected size related to the brix value of syrup being dispensed and the flow rate of carbonated water with which it is to be mixed. End 32B is provided with a flange 36, which acts as a stop when cylindrical body 32 is fully inserted within the end of syrup tube ST of FIG. 1. Thus, flange 36 acts as a stop for accurately positioning the orifice disc 40 at a distance Y below the atmospheric pressure head within container 10.

Adaptor 30 is fabricated from plastic and is not only used for inserting an orifice disc 40 into syrup tube ST, but for positioning the orifice disc 40 therein during a dispensing operation. In order to facilitate easy removal of orifice disc 40 and adaptor 30 from within the syrup tube ST, there is provided a pull-tab 38 which is ring-shaped with a central aperture to facilitate the insertion or gripping by an operator's fingers to readily remove the adaptor 30 from the tube. In a preferred embodiment, pull-tab 38 is integrally molded with adaptor 30 as an extension of flange 36, and substantially coplanar therewith. Therefore, when adaptor 30 is fully inserted within the syrup tube ST, ring-shaped pull-tab 38 lies in a position which is coplanar with flange 36 and does not interfere with any other surrounding parts of the valve assembly. When it is desired to remove adaptor 30 from the syrup tube ST, ring-shaped pull-tab 38 is grasped by the fingers of an operator and flexed as the entire adaptor 30 is pulled out of the syrup tube in a direction longitudinally of its central axis.

Use of the orifice disc insertion and removal device of the present invention may be more readily understood by the following example. Let us assume that the syrup container 10 contains Coca-Cola syrup ® (a registered trademark of The Coca-Cola Company) having a brix of 10.8 +0.4%. An operator would then test the carbonated water (soda) flow rate in the absence of syrup flow out of nozzle 24. The operator would then use the following chart to determine the proper orifice size of an orifice disc 40 to be utilized with the soda flow rate measured over a period of ten seconds.

| 1. MEASURE SODA FLOW FOR 10 SEC. COCA-COLA TARGET BRIX = 10.8 | | |
|---|---|---|
| TEN SECOND SODA FLOW | | ORIFICE SIZE |
| 200 | 209 | 0.110 inches |
| 210 | 219 | 0.113 inches |
| 220 | 229 | 0.116 inches |
| 230 | 240 | 0.119 inches |
| 241 | 250 | 0.122 inches |
| 251 | 260 | 0.125 inches |
| 261 | 270 | 0.128 inches |

For example, it can be seen from the above table that if the measured ten-second soda flow is in the range of 200 to 209 per second, that a disc 40 with a orifice size of 0.110 inches would be the appropriate selection. The operator would then select a disc 40 of this orifice size, place it in end 32A of adaptor 30 so that it is snuggly seated on shoulder 34, and insert the adaptor 30 into the syrup tube ST. The dispenser would then be ready to dispense a Coca-Cola beverage containing a proper mixture of Coca-Cola syrup and carbonated water.

If it is desired at some subsequent time to adjust the same valve mechanism and associated syrup tube for dispensing a syrup of a different brix value, one would simply grab the ring-shaped pull-tab 38 with their fingers; remove adaptor 30 from the syrup tube ST; and select an orifice disc 40 with an appropriate orifice size with respect to the brix of the new syrup selected. As stated hereinbefore, with the adaptor structure of the present invention this can be readily achieved without damage to either the interior of the syrup tube ST or the orifice disc 40 which was previously used.

In an alternative embodiment of the present invention, the orifice disc 40 could be integrally molded from plastic with the end portion 32A of adaptor 30, instead of using separate stainless steel orifice discs.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An orifice disc insertion and removal device for inserting and removing the disc from the interior of a syrup tube associated with the mixing chamber of a post-mix beverage dispenser, the orifice disc including a thin disc with a single orifice therein having a diameter selected to provide a predetermined constant rate of syrup flow into the mixing chamber for a given brix value, comprising:

(a) a cylindrical body with an outside diameter slightly greater than the inside diameter of a syrup tube into which the cylindrical body and the orifice disc are to be inserted, said cylindrical body being formed of pliable material;

(b) an inside, recessed, annular shoulder on one end of said cylindrical body forming a socket for supporting interchangeable orifice discs;

(c) a flange on the opposite end of said cylindrical body which is adapted to seat on the end of a syrup tube into which the body is inserted to accurately position the orifice disc disposed in said socket at a fixed position inside of the syrup tube, said fixed position being a predetermined distance from a syrup container to assure a proper mix of ingredients; and (d) a pull tab extending from said flange to permit the manual removal of said cylindrical body and orifice disc from said syrup tube when pulled by an operator's fingers.

2. The device of claim 1, wherein said pull-tab is ring-shaped, providing an opening in which the operator's fingers may be inserted.

3. The device of claim 2, wherein said pull-tab is flexible and is normally disposed coplanar with said flange until manually engaged and pulled by the operator's fingers.

4. The device of claim 3, wherein said cylindrical body is plastic and said pull-tab is integrally formed therewith.

5. The device of claim 1, wherein said pull-tab is flexible and is normally disposed coplanar with said flange until manually engaged and pulled by the operator's fingers.

6. An orifice disc insertion and removal device for inserting and removing the disc from the interior of a syrup tube associated with the mixing chamber of a post-mix beverage dispenser, the orifice disc including therein a thin disc having a diameter selected to provide a predetermined constant rate of syrup flow into the mixing chamber of a given brix value, comprising:

(a) a cylindrical body with an outside diameter slightly greater than the inside diameter of a syrup tube into which the cylindrical body and the orifice disc are to be inserted, said cylindrical body being formed of pliable material;

(b) an orifice disc being formed on one end of said cylindrical body;

(c) a flange on the opposite end of said cylindrical body which is adapted to seat on the end of a syrup tube into which the body is inserted to accurately position the orifice disc disposed at a fixed position inside of the syrup tube, said fixed position being a predetermined distance from a syrup container to assure a proper mix of ingredients; and (d) a pull-tab extending from said flange to permit the manual removal of said cylindrical body and orifice disc from said syrup tube when pulled by an operator's fingers.

7. The device of claim 6, wherein said pull-tab is flexible and is normally disposed coplanar with said flange until manually engaged and pulled by the operator's fingers.

8. The device of claim 7, wherein said cylindrical body is plastic and said pull tab is integrally formed therewith.

9. The device of claim 6, wherein said cylindrical body is plastic and said pull-tab is integrally formed therewith.

10. In a post-mix dispenser apparatus having a syrup supply container for feeding syrup by gravity through a syrup tube from a discharge opening of the container to an outlet opening of the syrup tube disposed within a mixing chamber of an underlying valve assembly, said syrup container having flow rate control tube with two open ends, one open end provided atmospheric pressure to the interior of the container at said one open end, the position of said one end being a fixed, predetermined distance above the outlet opening of said syrup tube, and an orifice disc insertion and removal device for inserting and removing the disc into or from the outlet. opening of the syrup tube, the orifice disc including a thin disc with an orifice therein having diameter selected to provide a predetermined constant rate of syrup flow through the syrup tube for a given brix value thereof, the improvement comprising:

(a) a cylindrical body with an outside diameter slightly greater than the inside diameter of a syrup tube into which the cylindrical body and the orifice disc are to be inserted, said cylindrical body being formed of pliable material;

(b) an orifice disc being formed on one end of said cylindrical body;

(c) a flange on the opposite end of said cylindrical body which is adapted to seat on the end of the syrup tube into which the body is inserted to accurately position the orifice disc disposed at a fixed position inside of the syrup tube below said one end of said flow rate control tube, said fixed position being a predetermined distance from a syrup container to assure a proper mix of ingredients; and (d) a pull-tab extending from said flange to permit the manual removal of said cylindrical body and orifice disc from said syrup tube when pulled by an operator's fingers.

11. The apparatus of claim 10, wherein said pull-tab is ring-shaped, providing an opening in which the operator's fingers may be inserted.

12. In the apparatus of claim 11, wherein said cylindrical body is plastic and said pull-tab is integrally formed therewith.

13. In the apparatus of claim 10, wherein said pull-tab is flexible and is normally disposed coplanar with said flange until manually engaged and pulled by the operator's fingers.

14. In the apparatus of claim 10, said one end of said cylindrical body having an inside, recessed, annular shoulder forming a socket for supporting interchangeable orifice discs.

* * * * *